US010794152B2

(12) United States Patent
Lang et al.

(10) Patent No.: US 10,794,152 B2
(45) Date of Patent: Oct. 6, 2020

(54) SUPPORT DEVICE FOR TUBING STRING

(71) Applicant: Halliburton Energy Services Inc., Houston, TX (US)

(72) Inventors: Loc Phuc Lang, Arlington, TX (US); David Joe Steele, Arlington, TX (US); Aihua Liang, Plano, TX (US)

(73) Assignee: Halliburton Energy Services Inc., Houston, TX (US)

( * ) Notice: Subject to any disclaimer, the term of this patent is extended or adjusted under 35 U.S.C. 154(b) by 376 days.

(21) Appl. No.: 15/748,238

(22) PCT Filed: May 3, 2017

(86) PCT No.: PCT/US2017/030756
§ 371 (c)(1),
(2) Date: Jan. 29, 2018

(87) PCT Pub. No.: WO2018/203889
PCT Pub. Date: Nov. 8, 2018

(65) Prior Publication Data

US 2020/0080402 A1 Mar. 12, 2020

(51) Int. Cl.

| | |
|---|---|
| ***E21B 41/00*** | (2006.01) |
| ***E21B 7/06*** | (2006.01) |
| *E21B 43/10* | (2006.01) |
| *E21B 43/14* | (2006.01) |
| *E21B 47/12* | (2012.01) |
| *E21B 23/12* | (2006.01) |

(52) U.S. Cl.
CPC ..... *E21B 41/0035* (2013.01); *E21B 7/061* (2013.01); *E21B 23/12* (2020.05); *E21B 43/10* (2013.01); *E21B 43/14* (2013.01); *E21B 47/12* (2013.01)

(58) Field of Classification Search
CPC ..... E21B 41/0035; E21B 7/061
See application file for complete search history.

(56) References Cited

U.S. PATENT DOCUMENTS

| | | | | |
|---|---|---|---|---|
| 4,573,541 | A * | 3/1986 | Josse | E21B 43/14 175/78 |
| 5,014,779 | A | 5/1991 | Salomatin et al. | |
| 5,318,121 | A | 6/1994 | Brockman et al. | |

(Continued)

FOREIGN PATENT DOCUMENTS

| | | |
|---|---|---|
| WO | 9967499 | 12/1999 |
| WO | 2015069886 | 5/2015 |

OTHER PUBLICATIONS

International Patent Application No. PCT/US2017/030756 , "International Search Report and Written Opinion", dated Nov. 28, 2017, 13 pages.

*Primary Examiner* — Shane Bomar
(74) *Attorney, Agent, or Firm* — Kilpatrick Townsend & Stockton LLP

(57) ABSTRACT

A support device may include an upper portion that has a first width and a base portion that has a second width. The support device may be sized to be positioned within a tubing string. The support device may be removable from the tubing string. The support device may include a vertical support that connects the upper portion to the base portion. The vertical support may have a third width and defining a fluid flow path between the vertical support and an inner surface of the tubing string.

17 Claims, 9 Drawing Sheets

(56) References Cited

U.S. PATENT DOCUMENTS

| | | | | |
|---|---|---|---|---|
| 5,467,826 | A | 11/1995 | Miller | |
| 6,334,634 | B1 * | 1/2002 | Osterkil | F16L 37/0925 285/322 |
| 6,729,410 | B2 | 5/2004 | Steele et al. | |
| 7,191,842 | B2 | 3/2007 | Hackworth et al. | |
| 8,286,718 | B2 | 10/2012 | Braddick | |
| 2003/0159827 | A1 | 8/2003 | Steele | |
| 2003/0234111 | A1 | 12/2003 | Echols et al. | |
| 2007/0089875 | A1 | 4/2007 | Steele et al. | |
| 2013/0277044 | A1 * | 10/2013 | King | E21B 43/26 166/192 |
| 2015/0233190 | A1 | 8/2015 | Wolf et al. | |
| 2016/0273312 | A1 | 9/2016 | Steele et al. | |

* cited by examiner

SUPPORT DEVICE FOR TUBING STRING

TECHNICAL FIELD

The present disclosure relates generally to wellbore assemblies, and more specifically (although not necessarily exclusively), to downhole tubing assemblies that may experience compressive forces.

BACKGROUND

A well can be a multilateral well. A multilateral well can have multiple lateral wellbores that branch off a main wellbore. Tubing strings may be positioned within the main wellbore and within the lateral wellbores. A tubing string may be exposed to forces downhole that can cause the tubing string to collapse and impede fluid flow through the tubing string.

DETAILED DESCRIPTION

Figure 1:
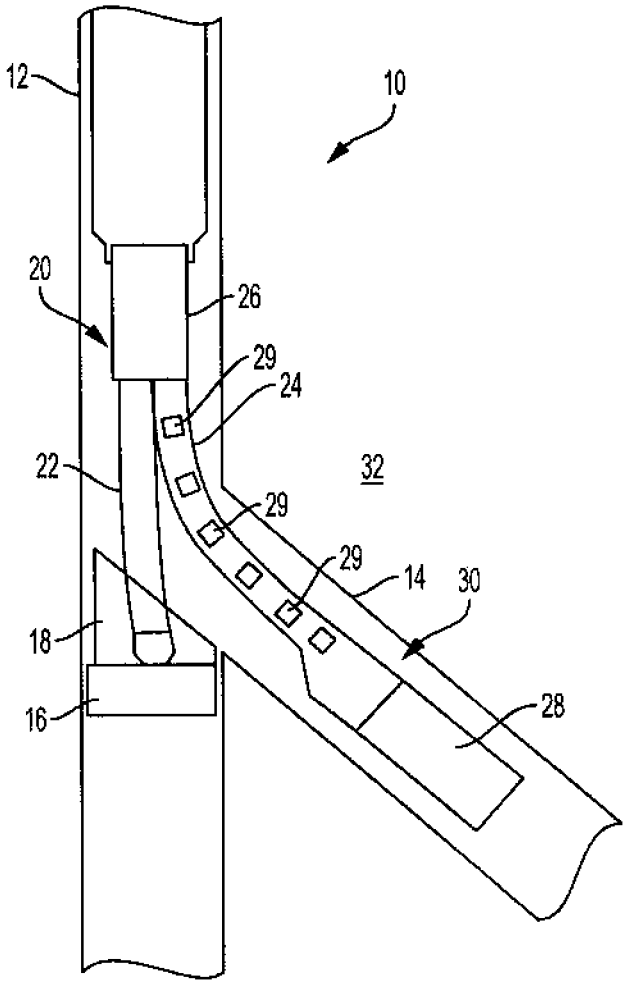
FIG. 1 is a cross-sectional view of a multilateral well system with a multi-branch inflow control junction positioned within the main wellbore and extending into a lateral wellbore, according to an aspect of the present disclosure.

Spatially relative terms, such as beneath, below, lower, above, upper, uphole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the uphole direction being toward the surface of the wellbore, the downhole direction being toward the toe of the wellbore. Unless otherwise stated, the spatially relative terms are intended to encompass different orientations of the apparatus in use or operation in addition to the orientation depicted in the figures. For example, if an apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Certain aspects and features relate to well systems, including multilateral well systems. A multilateral well can have multiple lateral wellbores that branch off a main wellbore. The main wellbore can be drilled vertically, directionally, or at an inclined angle, and the lateral wellbores can be drilled horizontally, or otherwise deviated, off the main wellbore. Tubing strings can be positioned within a multilateral well, including within a main wellbore and a lateral wellbore. In some aspects, a multi-branch inflow control junction that includes multiple tubing strings may be positioned within a main wellbore and a lateral wellbore. The multi-branch inflow control junction can include a lateral tube that may be flexible for ease of positioning the lateral tube in the lateral wellbore. The lateral tube may have a generally D-shaped cross-section ("D-shaped tube"). For example, the FlexRite System marketed by Sperry-Sun Drilling Services uses D-shaped tubing strings. Forces exerted on the lateral tube by the formation can cause the lateral tube to collapse.

In some aspects, support structures may be positioned within the lateral tube to provide support for the lateral tube and to aid in preventing the lateral tube from plastically deforming or collapsing in response to forces exerted on the lateral tube by the formation. The support structures may include support blocks or wedge jack supports that may be positioned within the lateral tube. In some aspects, the lateral tube may have a D-shaped cross section. In some aspects, the lateral tube may have a circular cross-section or other suitable cross-sectional shape. The support structures may be sized and shape to fit within the lateral tube. The support structures may also be sized and shaped to engage with other elements of the multi-branch inflow control junction or other downhole tools.

In some aspects, a support structure may be a support block. A first support block may be positioned at a first end of the lateral tube and may engage with a Y-connector of the multi-branch inflow control junction. A last support block may be positioned at an opposite end of the lateral tube and may engage with the fingers of a retaining sleeve of the multi-branch inflow control junction. Intermediate support structures may be positioned between the first and last support blocks and may be coupled to one another via any suitable coupling surface or structure, including but not limited to a connector rod that engages with an opening in the intermediate support block. The support blocks within the lateral tube may be spaced apart or laterally displaced from one another. The spaces between the support blocks may permit the lateral tube to flex as it is positioned within the lateral wellbore, while maintaining support to prevent the collapse or plastic deformation of the lateral tube. The block may be inserted and removed from a lateral tube or other tubing string in which support is desired.

In some aspects, the support structures may include wedge jack supports that include an upper wedge positioned on top of a lower wedge with a threaded rod positioned between the upper and lower wedge. The height of the wedge jack support can be increased by rotating the threaded rod in a first direction. Multiple wedge jack supports can be inserted within a tube, for example a lateral tube of a multi-branch inflow control junction having a D-shaped cross-section. Each wedge jack support can be inserted at a first height, and after insertion the threaded rod may be rotated in the first direction to increase the height of the wedge jack support until a top surface of the upper wedge contacts an inner surface of a top portion of the lateral tube. The wedge jack support may later be removed from the lateral tube. The threaded rod of the wedge jack support may be rotated in a second direction to lower the height of the wedge jack support prior to removing the wedge jack support. Lowering the height of the wedge jack support prior to removal may permit the wedge jack support to be more easily removed from the lateral tube.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 depicts a cross-sectional view of a multilateral well system 10 that includes a bore that is a main wellbore 12 and a lateral wellbore 14. A "main wellbore" may itself also be a lateral wellbore. The lateral wellbore 14 extends substantially horizontally from the main wellbore 12. Additional lateral wellbores may extend from the main wellbore 12. An anchoring device 16 may be positioned within the main wellbore 12 below a junction between the main wellbore 12 and the lateral wellbore 14. The anchoring device 16 may include, but is not limited to a packer, a latch, or a latch and inflatable seals. A diverter 18 may be received by the anchoring device 16 and may be positioned just below the junction between the main wellbore 12 and the lateral wellbore 14. The diverter 18 may aid in positioning tubing strings and other downhole equipment within the lateral wellbore 14.

A multi-branch inflow control junction 20 ("inflow control junction"), may be positioned within the main wellbore 12 and the lateral wellbore 14. The inflow control junction 20 may include a main tube 22 and a lateral tube 24, each secured at an upper end to a Y-connector 26, and an adaptor 28 coupled to an end 30 of the lateral tube 24. The Y-connector 26 may be positioned within the main wellbore 12 above the junction between the main wellbore 12 and the lateral wellbore 14. The main tube 22 may extend from the Y-connector 26 through the main wellbore 12 and into the diverter 18. In some aspects, the lateral tube 24 may have a D-shaped cross-section (a "D-shaped tube") and is deflected into the lateral wellbore 14 by the diverter 18. In some aspects, the lateral tube 24 may have a circular cross-section or other suitably shaped cross-section. The lateral tube 24 may be coupled to the adaptor 28 at the end 30 of the lateral tube 24 within the lateral wellbore 14. The adaptor 28 may connect the lateral tube 24 to equipment positioned downhole from the lateral tube 24 within the lateral wellbore 14.

The formation 32 above the lateral tube 24 of the inflow control junction 20 may exert forces on the lateral tube 24 that can cause the lateral tube 24 to collapse or deform plastically, which may restrict fluid flow through the lateral tube 24 and may require replacement of the lateral tube 24. In some aspects, support structures 29 may be positioned within the lateral tube 24 to increase the strength of the tube and increase the resistance of the lateral tube 24 to plastically deform in response to forces from the formation 32.

Figure 2A:
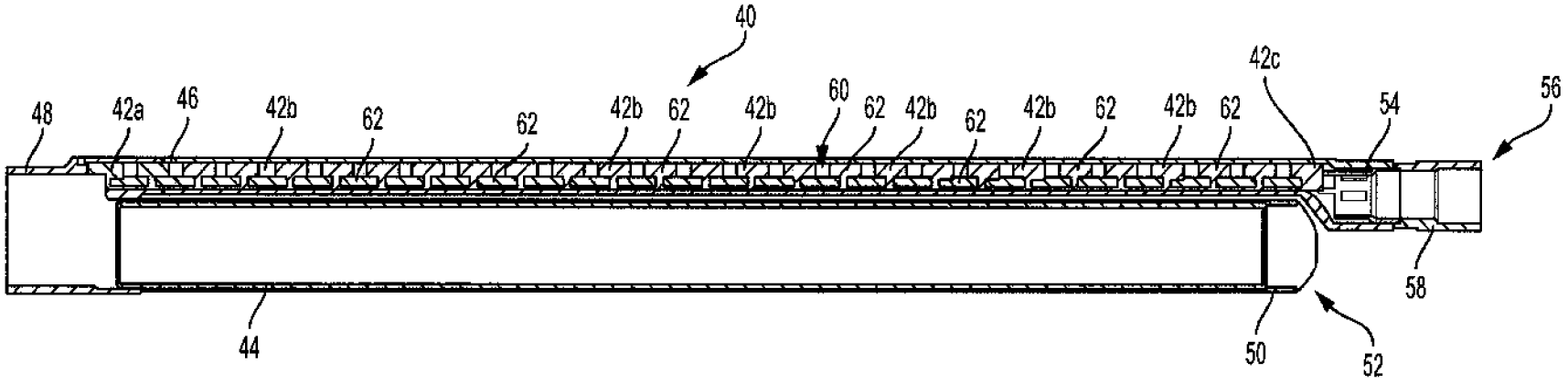
FIG. 2A is a cross-sectional view of a multi-branch inflow control junction positioned that includes support structures within the lateral tube, according to an aspect of the present disclosure.

FIG. 2A shows a cross-sectional view of a multi-branch inflow control junction 40 that includes support structures in the form of support blocks 42*a*, 42*b*, 42*c*. The inflow control junction 40 may include a main tube 44 and a lateral tube 46 each secured to and extending from a Y-connector 48. The inflow control junction 40 is shown in FIG. 2A prior to insertion into the wellbore, thus the main tube 44 and the lateral tube 46 are shown positioned parallel to one another. The main tube 44 may have a circular cross-section, a D-shaped cross-section, or any other suitable cross-sectional shape. A stinger 50 may be coupled to a downhole end 52 of the main tube 44 for coupling the main tube 44 to equipment within the main wellbore. The lateral tube 46 shown in FIG. 2A has a D-shaped cross-section, though in some aspects a circular cross-section or other suitable cross-sectional shape may be used. The lateral tube 46 may extend between approximately ten feet and approximately fifty feet in some aspects, in some aspects the lateral tube 46 may extend between approximately twenty feet and approximately thirty feet. The support blocks 42*a*, 42*b*, 42*c* are positioned within the lateral tube 46. The support blocks 42*a*, 42*b*, 42*c* can be made of a corrosion resistant alloy, for example corrosion resistant steel, or any other suitable material. A retaining sleeve 54 is positioned at a downhole end 56 of the lateral tube 46. An adaptor 58 may be coupled to the retaining sleeve 54 of the lateral tube 46 at the downhole end 56 of the lateral tube 46.

A first support block 42*a* may be positioned proximate to the Y-connector and may be shaped to be received by the Y-connector, as described in more detail below with reference to FIG. 2B. A last support block 42*c* may be positioned at the downhole end 56 of the lateral tube 46 proximate to the retaining sleeve 54 and may be shaped to be received by the retaining sleeve 54, as described in more detail below with reference to FIG. 2C and FIG. 4. The intermediate support blocks 42*b* are positioned between the first support block 42*a* and the last support block 42*c*. Adjacent support blocks 42*a*, 42*b*, 42*c* may be retained within the lateral tube 46 via a connector rod 62 that extends between two adjacent support blocks. An intermediate support block 42*b* is shown in more detail in FIG. 3, according to an aspect of the disclosure.

As shown in FIG. 2A, the support blocks 42*a*, 42*b*, 42*c* may be positionable within the lateral tube 46, for example a lateral tube 46 having a D-shaped cross-section. The support blocks 42*a*, 42*b*, 42*c* may be inserted into the lateral tube 46 and later removed from the lateral tube 46. The support blocks 42*a*, 42*b*, 42*c* may be retained within the lateral tube 46 via a frictional relationship between the support blocks 42*a*, 42*b*, 42*c* and an inner surface 60 of the lateral tube. The support blocks 42*a*, 42*b*, 42*c* may also be retained within the lateral tube 46 via the connector rods 62 that may extend between two adjacent support blocks. Each of the support blocks 42*a*, 42*b*, 42*c* are laterally displaced or spaced apart from the adjacent support blocks. A connector rod 62 may extend between the adjacent support blocks. The space provided between adjacent support blocks may permit the lateral tube 46 to flex and bend as the lateral tube 46 is positioned within the lateral wellbore.

Figure 2B:
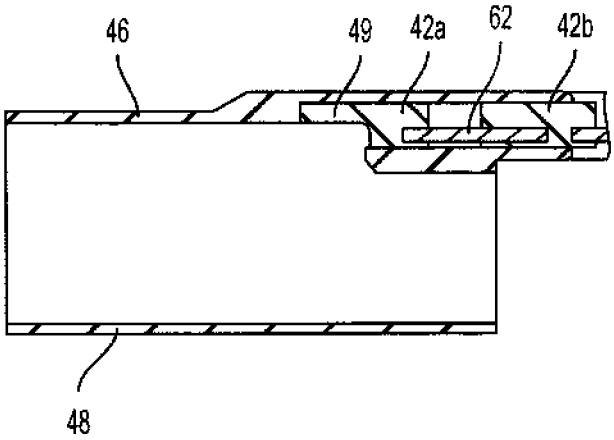
FIG. 2B is an enlarged view of a portion of the multi-branch inflow control junction of FIG. 2A, according to an aspect of the present disclosure.
Figure 3:
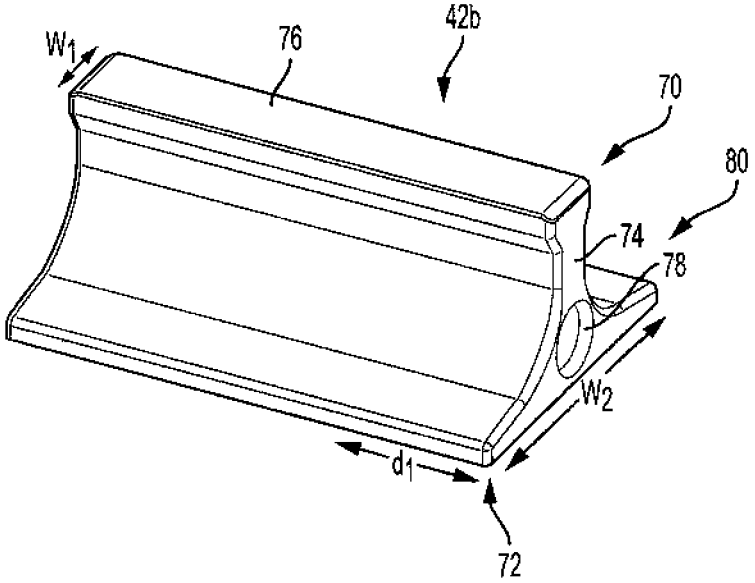
FIG. 3 is a perspective view of an intermediate support block, according to an aspect of the present disclosure.

FIG. 3 depicts a perspective view of the intermediate support block 42*b* of FIG. 2A. The intermediate support block 42*b* can have an upper portion 70 and a base portion 72 that are joined by a vertical support 74. The upper portion 70 can have a width $W_1$ that is smaller than a width $W_2$ of the base portion 72, in other words the upper portion 70 can be narrower than the base portion 72. The width $W_2$ of the base portion 72 can be larger than the width $W_1$ of the upper portion 70 to permit the intermediate support block 42*b* to fit within the lateral tube 46 having a D-shaped cross-section. The base portion 72 of the intermediate support block 42*b* can rest on a flat side the lateral tube 46 having a D-shaped cross section. The upper portion 70 of the intermediate support block 42*b* can extend proximate to the inner surface 60 of the lateral tube 46 (shown in FIG. 2A). The width $W_2$ of the base portion 72 can be sized to fit within the lateral tube 46 it will be inserted in. The intermediate support blocks 42*b* may be retained within the lateral tube 46 via the frictional relationship between a surface 76 of the upper portion 70 and the inner surface 60 of the lateral tube 46 (shown in FIG. 2A) and the frictional relationship between a surface (not shown) the base portion 72 and the inner surface 60 of the lateral tube 46 (shown in FIG. 2A). The larger width $W_2$ of the base portion 72 can also increase the frictional relationship between the support block 42*b* and the inner surface of the lateral tube 46. The width $W_2$ of the base portion 72 of the intermediate support block 42*b* may prevent the intermediate support block 42*b* from rotating or moving within the lateral tube 46 (shown in FIG. 2A). The vertical support 74 can have a width that defines a flow path between the vertical support 74 and the inner surface of the lateral tube. As shown in FIG. 2B, the width of the vertical support 74 can be less than the width $W_2$ of the base portion 72. In some aspects, the lateral tube 46 may have a different cross-sectional shape and the width $W_2$ of the base portion 72 may be the same as or smaller than the width $W_1$ of the upper portion 70. In some aspects, the width of the vertical support 74 can be greater than the width $W_1$ of the upper portion 70 and may be as great or greater than the width $W_2$ of the base portion 72.

The support blocks 42*a*, 42*b*, 42*c* may also be retained within the lateral tube 46 the connector rods 62 (shown in FIG. 2A) that extend between two adjacent support blocks. As shown in FIG. 3, the connection rods may be positioned within an opening or recess 78 in an end 80 of the intermediate support block 42*b*. The opening 78 may be threaded with the connection rod having a corresponding thread. The opening may extend into the intermediate support block 42*b* a desired depth $d_1$. In some aspects, the opening 78 may extend completely through the intermediate support block 42*b*. In some aspects, an opening 78 may be positioned on both ends of the intermediate support block 78. In some aspects, the opening 78 may be threaded, for example but not limited to fully threaded or partially threaded. In some aspects, the intermediate support block 42*b* may also include projections or other extensions that extend into the opening 78 and determine the desired depth $d_1$ that the connection rod may extend into the intermediate support block 42*b*. The first support block 42*a* and last support block 42*c* may also include openings as described with respect to the intermediate support blocks 42*b*. As shown in FIG. 2A, the connector rod 62 may not extend all the way through each of the support blocks 42*a*, 42*b*, 42*c* and may be laterally displaced from the adjacent connector rod 62. The lateral spacing between the connector rods 62 may permit the lateral tube 46 to flex or bend when inserted into a lateral wellbore. In some aspects, a support block may include a pin that extends from a side of the support block. The pin may be sized to be received in an opening in an end of an adjacent support block. The pin may extend through only a portion of the length of the adjacent support block, permitting the lateral tube to retain flexibility during insertion into the lateral wellbore. In some aspects, one or more intermediate support blocks 42*b* may include other suitable coupling surfaces, for example but not limited to a combination of pins, openings, threaded surfaces, or other suitable coupling surfaces for securing the intermediate blocks 42*b* at a desired spacing.

FIG. 2B shows an enlarged view of a portion of FIG. 2A depicting the first support block 42*a* coupled to the Y-connector 48. The first support block 42*a* may be coupled to the Y-connector 48 by a finger 49 extending from an end of the first support block 42*a* that is sized to be received by a recess in the Y-connector 48. The first support block 42*a* may be coupled to an intermediate support block 42*b* by the connector rod 62. The coupling between the first support block 42*a* and the Y-connector 48 may aid in retaining the support blocks 42*a*, 42*b*, 42*c* positioned along the length of the lateral tube 46 in place.

Figure 2C:
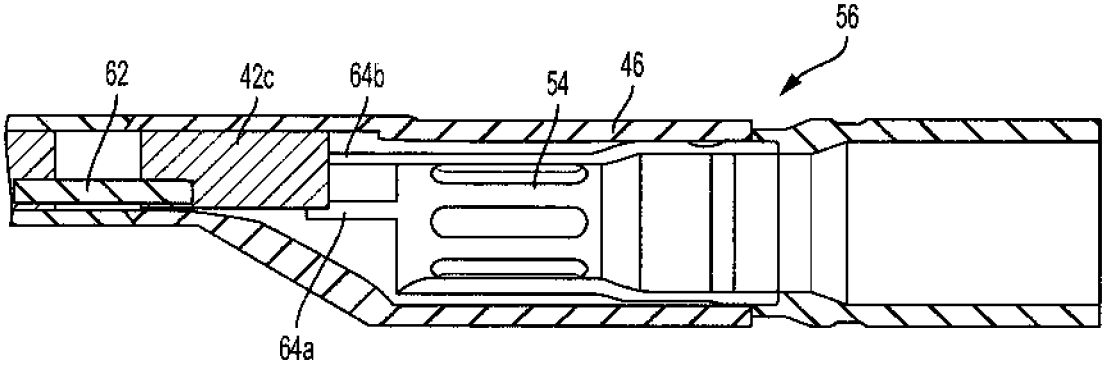
FIG. 2C is an enlarged view of another portion of the multi-branch inflow control junction of FIG. 2A, according to an aspect of the present disclosure.
Figure 4:
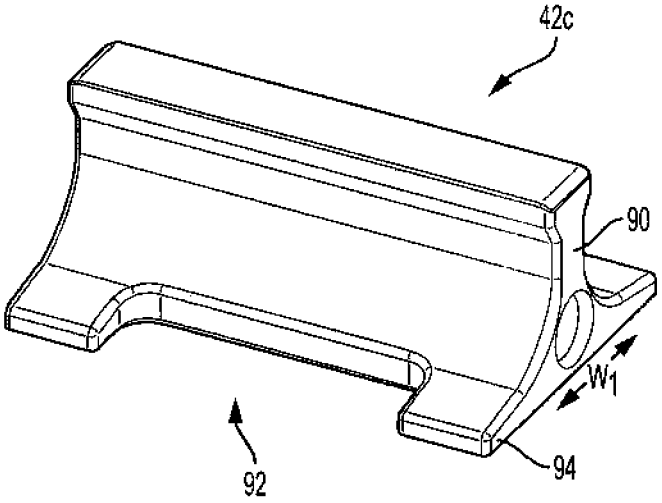
FIG. 4 is a perspective view of a last support block, according to an aspect of the present disclosure.

As shown in FIG. 2C, an enlarged view of a portion of FIG. 2A depicting the downhole end 56 of the lateral tube 46, the last support block 42*c* may be coupled to and held in place by the fingers 64*a*, 64*b* of the retaining sleeve 54 of the inflow control junction 40 (shown in its entirety in FIG. 2A). FIG. 4 shows a perspective view of the last support block 42*c* of FIGS. 2A and 2C, according to an aspect of the disclosure. A vertical support 90 of the last support block 42*c* may have a width $W_1$ that is sized to be received by fingers 64*a*, 64*b* (shown in FIG. 2C and FIG. 5) of the sliding sleeve 54 (shown in FIG. 2C and FIG. 5).

Figure 5:
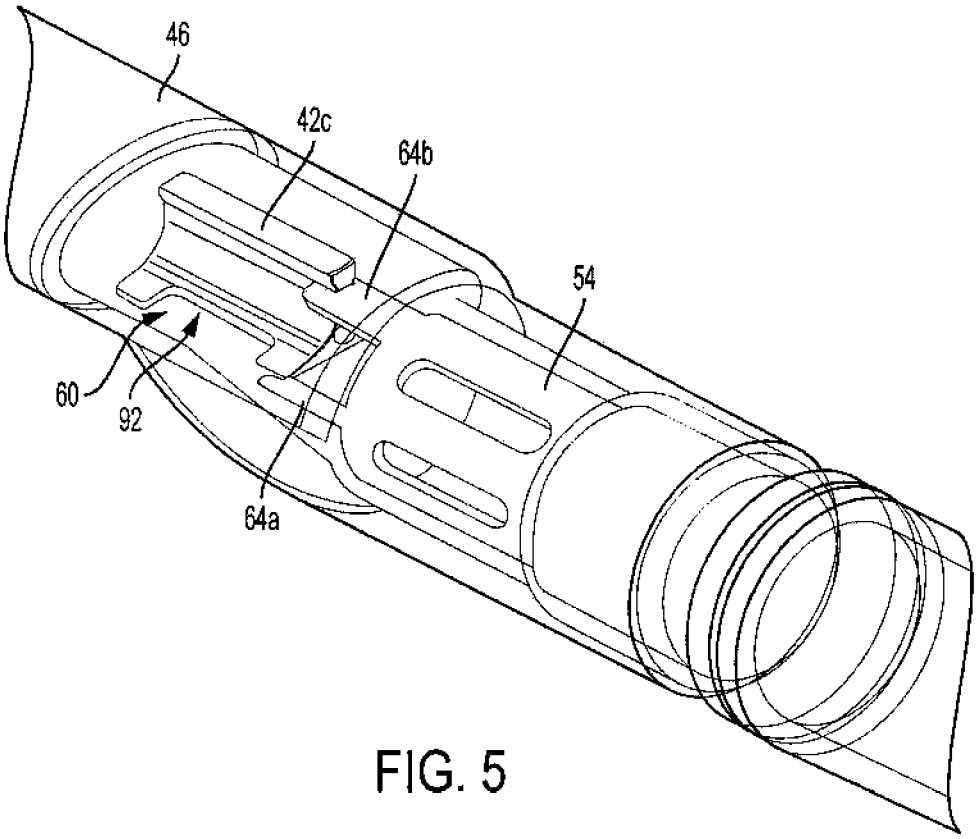
FIG. 5 is a perspective view of the multi-branch inflow control junction of FIG. 2A at a downhole end of the lateral tube, according to an aspect of the present disclosure.

As shown in FIG. 4, the last support block 42*c* may include an outer edge that defines a groove or a recess 92 in one or both sides of a base portion 94 of the last support block 42*c*. FIG. 5 depicts a perspective view of the last support block 42*c* positioned within the lateral tube 46 and coupled to the fingers 64*a*, 64*b* of the retaining sleeve 54. The groove 92 may increase the dimensions of a flow path between the last support block 42*c* and an inner surface 60 of the lateral tube 46 at the downhole end 56 of the lateral tube 46 proximate to the retaining sleeve 54. In some aspects, the last support block 42*c* may not include the groove 92.

Figure 6:
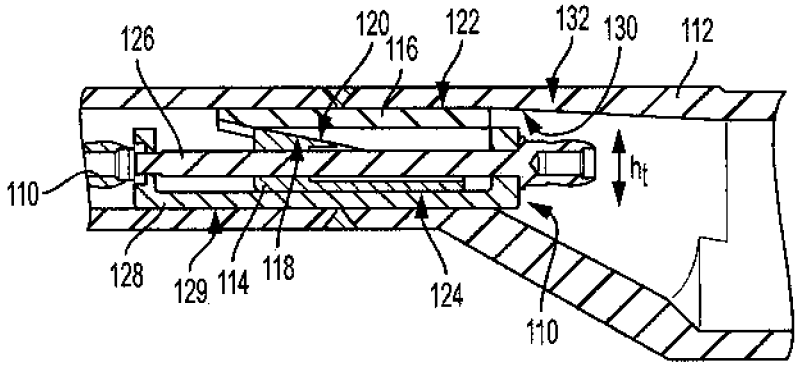
FIG. 6 is a cross-sectional view of tubing string that includes a wedge jack support, according to an aspect of the present disclosure.
Figure 7:
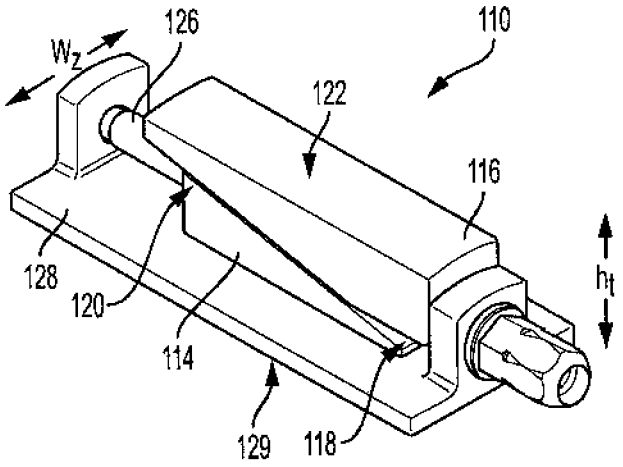
FIG. 7 a perspective view of a wedge jack support, according to an aspect of the present disclosure.

FIG. 6 shows a support structure, specifically a wedge jack support 110 positioned within a tube 112 according to an aspect of the present disclosure. Though only one wedge jack support 110 is shown in the portion of the tube 112 visible in FIG. 6, multiple wedge jack supports 110 may be positioned along a length of the tube 112. In some aspects, the tube 112 may be a tube having a D-shaped cross-section. In some aspects, the tube 112 may have a different cross-sectional shape. In some aspects, multiple wedge jack supports 110 can be inserted within a lateral tube of a multi-branch inflow control junction to increase the strength of the lateral tube, for example but not limited to increasing the yield strength, the ultimately strength, or the compressive strength of the lateral tube. FIG. 7 shows a perspective view of the wedge jack support 110. As shown in both FIG. 6 and FIG. 7 the wedge jack support 110 can include a lower wedge 114 and an upper wedge 116. The lower wedge 114 can have a top surface 118 that is an angled surface. The upper wedge 116 can have a bottom surface 120 that is angled to rest on the top surface 118 of the lower wedge 114. A top surface 122 of the upper wedge 116 may be substantially parallel with a bottom surface 124 of the lower wedge 114. A threaded rod 126 can pass between the upper wedge 116 and the lower wedge 114 and can be coupled to a base plate 128 at each end of the threaded rod 126.

As shown in FIG. 7, the base plate 128 of the wedge jack support 110 can have a width $W_2$ that is sized to fit on a flat surface of tube, for example the flat surface of a tube having a D-shaped cross-section. The upper wedge 116 and the lower wedge 114 can each have a width that is sized to fit within a tube, for example tube 112 (shown in FIG. 6), and define a fluid flow path through the tube around the wedge jack support 110.

The wedge jack support 110 can have a total height $h_t$ from a bottom surface 129 of the base plate 128 to the top surface 122 of the upper wedge 116. The threaded rod 126 can be turned by a user in a first direction to increase the total height $h_t$ of the wedge jack support 110. The threaded rod 126 can be coupled to the upper wedge 116 and the lower wedge 114 to force the upper wedge 116 and the lower wedge 114 to linearly compress in response to the threaded rod 126 being turned in the first direction. The upper wedge 116 and lower wedge 114 can vertically expand, increasing the total height $h_t$ of the wedge jack support 110, in response to being linearly compressed by turning the threaded rod 126 in the first direction.

The wedge jack support 110 can be positioned within a tube at an initial total height $h_t$ The initial total height $h_t$ of the wedge jack support 110 may be smaller than a height of the tube such that the top surface 122 of the upper wedge 116 does not contact an inner surface 140 of a top 132 of the tube 112 (shown in FIG. 6). As shown in FIG. 6, once positioned within the tube, the total height $h_t$ of the wedge jack support 110 can be increased by turning the threaded rod 126 until the top surface 122 of the upper wedge 116 is in contact with an inner surface 130 of a top 132 of the tube 112. Multiple wedge jack supports 110 may be inserted into the tube 112 to extend a length of the tube 112 and provide support to the tube 112. Each one of the wedge jack supports 110 within the tube 112 may have total height $h_t$ of the wedge jack support 110 adjusted to position the top surface 122 of the upper wedge 116 against the inner surface 130 of the top 132 of the tube 112. The total height $h_t$ each of the wedge jack supports 110 can also be decreased by turning the threaded rod 126 in a second direction. The upper wedge 116 and the lower wedge 114 may linearly expand and reduce the total height $h_t$ of the wedge jack support 110 in response to the threaded rod 126 being turned in the second direction. The wedge jack supports 110 within the tube 112 can be more easily removed from the tube 112 when the wedge jack support 110 is not in contact with the inner surface 130 of the top 132 of the tube 112.

In some aspects, the support device may comprise an upper surface and a lower surface. The distance between the upper surface and the lower surface of the support device can define a height of the support device. The support device can have an adjustable height. The height of the support device may be adjusted via a threaded rod or screw, in some aspects the height may be adjusted via hydraulic or electrical power. In still yet other aspects, other suitable means for adjusting the height of the support device may also be used. The support device may be inserted within a tubing string at an inserted height. The height of the support device may be increased when the support device is positioned within the tubing string. The height of the support device may be increased to a supported height where the upper surface of the support device is in contact with an inner surface of the top region of the tubing string and the lower surface is in contact with the inner surface of the bottom region of the tubing string. Thus, the supported height of the support device may correspond to a vertical height of an interior region of the tubing string. The supported height of the support device may be less than a maximum height of the support device when the support device is not positioned within the tubing string. In some aspects, the support device may comprise scissor arms that may be positioned to increase or decrease the height of the support device. In some aspects, the support device may be a wedge jack device that does not include a base plate. In some aspects, the support device may include rams or extensions. The height of the support device can be increased or decreased via mechanical power, hydraulic power, electrical power, or other suitable power sources.

A tubing string that includes support structures, for example a lateral tube of a multi-branch lateral junction that includes support blocks, can have a greater collapse rating compared to a tube that does not include support blocks. In some aspects, a lateral tube having support blocks inserted within the tube may have a collapse rating that is more than 2.6 times greater than the same lateral tube without support blocks inserted within the tube. A lateral wellbore may experience high compression due to the formation exerting a force, for example a crushing or compressive force, from above, resulting in a local area of pressure on the lateral tube within the lateral wellbore in one direction. The use of support blocks within the lateral tube can provide sufficient support in the direction of compression to prevent the lateral tube from plastically deforming in that direction. For example, a lateral tube having a D-shaped cross-section that includes support blocks, for example the lateral tube 46 and support blocks 42*a*, 42*b*, 42*c* (shown in FIG. 2A), under 400,000 lbf of compressive force does not deform or collapse under this compression force. The lateral tube having support blocks under 400,000 lbf of compressive force may have a stress measurement of about 62 ksi based on a Von-Mises Stress model. However, the same lateral tube without any support blocks (for example lateral tube 46 without support blocks 42*a*, 42*b*, 42*c*) may experience a stress measurement of about 80 ksi under only 175,000 lbf of compressive force based on a Von-Mises Stress model. Thus the lateral tube with the support blocks may have a lower stress measurement when experiencing a higher amount of compressive force compared to the lateral tube without support blocks. Similarly, a tube with wedge jack supports positioned within the tube may have a lower stress measurement at a higher compressive force than the same tube without wedge jack supports inserted within the tube. A tube having wedge jack supports positioned therein may not plastically deform or collapse in response to an external force that would otherwise cause the tube to plastically deform or collapse.

Example #1

A support device may include an upper portion that has a first width and is sized to be positioned within a tubing string. The upper portion may be removable from the tubing string. The support device may include a base portion that has a second width and is sized to be positioned within a tubing string and is removable from the tubing string. The support device may also include a vertical support connecting the upper portion to the base portion and having a third width that is sized to define a fluid flow path between the vertical support and an inner surface of the tubing string.

Example #2

The support device of Example #1 may further include a coupling surface for coupling the support device to an additional support device.

Example #3

The support device of Example #1 may further feature the coupling surface comprising an opening sized to receive a connector rod for coupling the support device to the additional support device.

Example #4

Any of the support devices of Examples #1-3 may further feature the base portion comprising an outer edge that defines a recess in the base portion for increasing an area of the fluid flow path between the support device and the inner surface of the tubing string.

Example #5

Any of the support devices of Examples #1-4 may further feature the width of the vertical support proximal to the upper portion of the support device being sized to be received by a sliding sleeve positioned within the tubing string.

Example #6

Any of the support devices of Examples #1-5 may further feature the second width of the base portion being larger than the first width of the upper portion and may further feature the tubing string having a D-shaped cross-section.

Example #7

Any of the support devices of Examples #1-6 may further feature the third width of the vertical support is smaller than the second width of the base portion, and may feature further the tubing string being a lateral tube.

Example #8

Any of the support devices of Examples #1-3 may further feature the upper portion of the support device including a finger sized to be received by a y-connector.

Example #9

A support device may include an upper contact surface for contacting an inner surface of a top portion of a tubing string. The device may include a lower contact surface positioned below the upper contact surface, the lower contact surface for contacting the inner surface of a lower portion of a tubing string. The support device may have a height that is defined by the distance between the lower contact surface and the upper contact surface. The height of the support device may be adjustable between an inserted height and a supported height and the inserted height may be less than the supported height and the supported height may be substantially equal to a vertical height of an interior region of the tubing string.

Example #10

The support device of Example #9 may further feature the upper contact surface being a top surface of an upper wedge and the lower contact surface being a bottom surface of a lower wedge. The upper wedge may be positioned above the lower wedge.

Example #11

The support device of any of Examples #9-10 may further feature a base plate positioned below the lower wedge, the base plate having a sized to be positioned within the tubing string having a D-shaped cross-section, and may further feature a bottom surface of the base plate that contacts a flat surface of the tubing string.

Example #12

The support device of any of Examples #9-11 may further feature the support device having a width that is sized to define a flow path between the inner surface of the tubing string and the support device.

Example #13

The support device of any of Examples #9-12 may further feature a threaded road positioned between the upper wedge and the lower wedge.

Example #14

The support device of Example #13 may further feature the threaded rod being rotatable in a first direction for increasing the height of the support device.

Example #15

The support device of any of Examples #13-14 may further feature the threaded rod being rotatable in a second direction for reducing the height of the support device in response to the threaded rod being rotated in the second direction.

Example #16

A tubing string may include an inner surface defining an inner region and at least one support structure positioned within the inner region for increasing a resistance of the tubing string to external forces. The tubing string may include at least one of support structure that is removably positioned within the inner region of the tubing string.

Example #17

The tubing string of Example #16 may further feature a plurality of support structures. Each of the plurality of support structures may be support blocks. A first support structure of the plurality of support structures may be linearly displaced and separate from an adjacent support structure for maintaining flexibility of the tubing string.

Example #18

The tubing string of Example #17 may further feature the first support structure being coupled to the adjacent support structure by a connector rod. The connector rod may extend only partially through each of the first support structure and the adjacent support structure.

Example #19

The tubing string of Example #16 may further feature the at least one support structure further including an upper wedge and a lower wedge. The lower wedge may be positioned below the upper wedge. The structure support may further include a base plate coupled to the lower wedge and a threaded rod positioned between and coupled to the upper wedge and the lower wedge. At least one support structure may have a height defined by a distance between a bottom surface of the base plate and a top surface of the upper wedge.

Example #20

The tubing string of Example #19 may further feature the threaded rod being is rotatable in a first direction for increasing the height of the support structure and rotatable in a second direction for reducing the height of the support structure.

The foregoing description of the aspects, including illustrated aspects, of the present disclosure has been presented only for the purpose of illustration and description and is not intended to be exhaustive or to limit the subject matter to the precise forms disclosed. Numerous modifications, adaptations, and uses thereof will be apparent to those skilled in the art without departing from the scope of this subject matter.

What is claimed is:

1. A support device comprising:

an upper portion that has a first width and is sized to be positioned within a tubing string and is removable from the tubing string;

a base portion that has a second width and is sized to be positioned within the tubing string and is removable from the tubing string;

a vertical support connecting the upper portion to the base portion and having a third width that is sized to define a fluid flow path between the vertical support and an inner surface of the tubing string; and a coupling surface for coupling the support device to an additional support device, the coupling surface comprising an opening extending partially through the support device, the opening sized and shaped to receive a connector rod for coupling the support device to the additional support device such that the connector rod extends only partially through the support device.

2. The support device of claim 1, wherein the base portion further comprises an outer edge that defines a recess in the base portion for increasing an area of the fluid flow path between the support device and the inner surface of the tubing string.

3. The support device of claim 2, wherein a width of the vertical support proximal to the upper portion of the support device is sized to be received by a sliding sleeve positioned within the tubing string.

4. The support device of claim 1, wherein the second width of the base portion is larger than the first width of the upper portion and wherein the tubing string has a D-shaped cross-section.

5. The support device of claim 4, wherein the third width of the vertical support is smaller than the second width of the base portion, and wherein the tubing string is a lateral tube.

6. The support device of claim 1, wherein the upper portion of the support device includes a finger sized to be received by a y-connector.

7. A support device comprising:

an upper contact surface for contacting an inner surface of a top portion of a tubing string;

a lower contact surface positioned below the upper contact surface, the lower contact surface for contacting the inner surface of a lower portion of the tubing string, and the support device having a height defined by a distance between the lower contact surface and the upper contact surface, the height of the support device being adjustable between an inserted height and a supported height, the inserted height being less than the supported height and the supported height being substantially equal to a vertical height of an interior region of the tubing string.

8. The support device of claim 7, wherein the upper contact surface is a top surface of an upper wedge and the lower contact surface is a bottom surface of a lower wedge, the upper wedge being positioned above the lower wedge.

9. The support device of claim 8, further comprising a base plate positioned below the lower wedge and having a width, the width of the base plate being sized to be positioned within the tubing string having a D-shaped cross-section, wherein a bottom surface of the base plate contacts a flat surface of the tubing string.

10. The support device of claim 7, wherein the support device has a width that is sized to define a flow path between the inner surface of the tubing string and the support device.

11. The support device of claim 8 further comprising a threaded rod positioned between the upper wedge and the lower wedge.

12. The support device of claim 11, wherein the threaded rod is rotatable in a first direction for increasing the height of the support device.

13. The support device of claim 12, wherein the threaded rod is rotatable in a second direction for reducing the height of the support device in response to the threaded rod being rotated in the second direction.

14. A tubing string comprising:

an inner surface defining an inner region;

a plurality of support structures positioned within the inner region for increasing a resistance of the tubing string to external forces, wherein each support structure of the plurality of support structures is removably positioned within the inner region of the tubing string, wherein each support structure of the plurality of support structures is a support block, and wherein a first support structure of the plurality of support structures is coupled to an adjacent support structure by a connector rod, wherein the connector rod extends only partially through each of the first support structure and the adjacent support structure.

15. The tubing string of claim 14, wherein the first support structure of the plurality of support structures is linearly displaced and separate from the adjacent support structure for maintaining flexibility of the tubing string.

16. The tubing string of claim 14, wherein the first support structure further comprises:

an upper wedge;

a lower wedge positioned below the upper wedge;

a base plate coupled to the lower wedge; and a threaded rod positioned between and coupled to the upper wedge and the lower wedge, wherein the first support structure has a height defined by a distance between a bottom surface of the base plate and a top surface of the upper wedge.

17. The tubing string of claim 16, wherein the threaded rod is rotatable in a first direction for increasing the height of the first support structure and rotatable in a second direction for reducing the height of the first support structure.

* * * * *